United States Patent [19]

Brooks et al.

[11] Patent Number: 4,971,742

[45] Date of Patent: Nov. 20, 1990

[54] METHOD AND APPARATUS FOR FORMING A HIGHLY ISOTROPIC WEB STRUCTURE

[75] Inventors: Stanley H. W. Brooks, Rochester; William B. Surber, Birmingham, both of Mich.

[73] Assignee: General Motors Corporation, Detroit, Mich.

[21] Appl. No.: 350,890

[22] Filed: May 12, 1989

[51] Int. Cl.[5] ..... B27N 3/04

[52] U.S. Cl. ..... 264/118; 264/40.1; 264/40.7; 264/518; 264/115; 425/82.1; 425/83.1

[58] Field of Search ..... 264/40.1, 40.4, 40.7, 264/518, 115, 116, 118; 425/80.1, 82.1, 83.1

[56] References Cited

U.S. PATENT DOCUMENTS

| | | | |
|---|---|---|---|
| 2,744,045 | 5/1956 | Collins | 425/82.1 |
| 3,781,150 | 12/1973 | Matsumura et al. | 264/113 X |
| 3,918,126 | 11/1975 | Wood | 19/156.3 |
| 3,949,035 | 4/1976 | Dunning et al. | 264/121 X |
| 3,984,898 | 10/1976 | Matsumura et al. | 19/156.3 |
| 4,035,121 | 7/1977 | Wood | 425/83.1 |
| 4,097,209 | 7/1978 | Garrick et al. | 425/82.1 |
| 4,102,963 | 7/1978 | Wood | 264/121 X |
| 4,264,290 | 4/1981 | Dunkerly, II et al. | 425/83.1 |
| 4,350,482 | 9/1982 | Alexandrov et al. | 425/83.1 |
| 4,734,236 | 3/1988 | Davis | 264/112 |
| 4,847,022 | 7/1989 | Bold | 264/40.7 |

FOREIGN PATENT DOCUMENTS

| | | | |
|---|---|---|---|
| 2942163 | 4/1981 | Fed. Rep. of Germany | 425/80.1 |
| 2136754 | 9/1984 | United Kingdom | 425/83.1 |

*Primary Examiner*—Mary Lynn Fertig

*Attorney, Agent, or Firm*—Randy W. Tung

[57] ABSTRACT

Apparatus for forming highly isotropic web products includes an elevator that adjustably positions a former head and an associated air and fiber supply with respect to a product condenser for varying the width and density of an isotropic web formed thereon. The process of the present invention includes selectively directing individual fibers into first and second vertical air curtains the first of which is intercepted by a backwardly inclined condenser for forming a first feed mat which is stripped to form the fiber supply for the second vertical air curtain and wherein the velocity and the height of the second vertical air curtain are controlled to control the density and width of a resultant isotropic web structure formed on a continuous belt type condenser.

13 Claims, 7 Drawing Sheets

Fig-3

METHOD AND APPARATUS FOR FORMING A HIGHLY ISOTROPIC WEB STRUCTURE

FIELD OF THE INVENTION

This invention relates to apparatus and method for forming a mat or web from individual fibers of material and more particularly to such apparatus and method in which the individual fibers are conveyed in gas streams for deposit on perforated surface.

BACKGROUND OF THE INVENTION

Molding processes are known in which fibers are combined with a thermosetting resin and a catalyst and placed in a mold tool to be pressure formed under heat. U.S. Pat. Nos. 4,035,121 and 4,102,963 disclose two different machines for combining resin and fibers in an air laid web structure.

In use, the uniformity of the mat of Web material formed by the '121 patent has been found to be dependent on the level of the fiber maintained in the fiber feed section of the machine. The level of the fiber in the feeder will cause the amount of fiber fed by an elevating apron to vary in the longitudinal flow or mat direction as the fiber feed level changes. In one form of commercially available machine the fiber from the elevator apron is directed through an air bridge which feeds fibers along a horizontal reach to a first perforated evacuated surface to form a feed mat. If the vacuum on the perforated surface is too low, and if the fiber level in the feed section is too great, an excessive amount of fiber will build up in the upstream end of the air bridge. The excess fiber not taken by the air bridge must be fed back into the feeder by a separate top stripper. The result is a system which requires adjustment of multiple variables including feed bin level; vacuum level; top stripper speed and the speed of the elevator apron. The large number of variables makes it difficult to form a feed mat of uniform density. Consequently, subsequent separation of fibers from the feed mat and subsequent final mat build up will not be uniform.

Many final web former structures include a lickerin cylinder located a fixed short distance from a web condenser for forming an air laid web. One example of such a final web former structure is shown in U.S. Pat. No. 3,918,126. The short distance is provided in an attempt to reduce the horizontal reach of the discharge duct from the lickerin. Nevertheless, the horizontal reach will tend to produce differential separation of different density fibers as they are carried through the duct by primary carrier gas. Also, such short distance relationship causes the final mat to develop as a series of shingles formed at approximately 50 degrees to 60 degrees in the direction that the fibers are formed onto the evacuated perforated surface of a final mat forming condenser.

The shingle effect produces weakened sections in web densities in the 35 to 80 oz. per square yard mat weight range, e.g., the higher the mat weight, the more pronounced is the shingle effect. Such weakened sections make it difficult to roll or otherwise handle the final mat without separation at the weakened sections.

In the past it has been necessary to consolidate weakened sections by use of a compaction oven in which the weakened sections are consolidated and fused using low melt thermoplastic fibers or entrained thermoplastic powders to hold the mat sections together. Optionally, such weakened mat sections can be given greater integrity by use of needle looms which knit the weakened fibers together for handling strength. Machines of this type require maintenance to the needles and adjustment of other variables, but does produce a final mat structure that is easily handled by the molder.

Other air laid web machines address velocity differentiation of different density fibers by use of structure designed to produce a uniform air flow velocity for carrying the fibers to the perforated evacuated surfaces for forming the final mat product. One such machine is shown in U.S. Pat. No. 3,949,035 wherein multiple air streams include a primary air stream, a secondary air stream as well as a process air stream. Each stream must be adjusted one to the other to obtain a desired final mat build-up. U.S. Pat. No. 4,264,290 discloses another machine to produce uniform velocity carrying gas streams. The '290 machine requires use of flow reversing inductors to stabilize velocity, Which can produce a flocking or build up of individual fibers prior to deposition on the evacuated perforated surface of a final web condenser. U.S. Pat. No. 4,350,482 discloses an air flow system for production of fibrous sheet material in which a uniform velocity front is maintained by a plurality of louver type vanes which are adjusted in accordance with the amount of fibers carried by the process stream.

Other air lay web apparatus is known for combining different types of fibers into the final mat structure. Such apparatus are shown in U.S. Pat. Nos. 3,781,150 and 3,984,898 both of which combine short and long fiber to form a final mat product.

SUMMARY OF THE INVENTION

The apparatus and method of the present invention produces a web structure that approaches isotropic mechanical strength properties in the X—Y plane of a resultant final web product.

An objective of the invention is to be capable of producing isotropic web structure using a wide range of fibers, such as wood pulp and long fibers, such as textile crimped and uncrimped and from 1.5 denier to over 40 denier and from ¼ inch to over 3 inches in length. This device is also capable of handling glass fiber of comparable or greater length and varying from 3 microns to over 10 microns in diameter. The apparatus is also capable of forming non-wood fibers, such as Kenaf (*Hibiscus cannabinus* L.) and sugar cane residual known as Bagasse, as well as jute and other natural fibers.

These various fibers are usually bailed at their place of origin and are shipped into the mat laying facility in bail forms. For instance, the wood fibers come in a bail 36"×40"×7, long and a density of over 26 lbs. per cubic foot. These bails weight approximately 2,000 lbs. at 95% solids. The textile fiber is also compacted into a bail density of over 15 lbs. per cubic foot and 600 lbs. The other fibers are also received in bail form.

The bails are debailed through specially designed bail openers and the individual fibers are either blended in various proportions or are individually fed to process depending on the end product to be produced. These fibers are fed through a two stage Sargent Picker or equivalent pin drum opener to blend the various fibers. The fiber or blend of fibers is conveyed using a pneumatic or mechanical system to a series of opening lickerins to maintain the fibers in an open or untangled condition and prevent fiber bundles from forming prior to being deposited in the accumulator or fiber metering doffing roll bin.

The discharge from the doffing roll bin is in turn directed through another series of lickerins to again be sure that no fiber bundles or as few fiber bundles as possible are formed prior to the fibers being delivered or fed to the backward inclined feeder condenser.

The backward inclined feeder condenser is independent of fiber density in the doffing roll bin above as it only gets the amount of fiber needed to form a feed mat by the amount of vacuum produced by the vacuum fan controlling the suction on the backward inclined feeder condenser.

The feed mat as formed above is doffed from the backward inclined feeder condenser into the specially designed rubber covered feed roll. The rubber covered feed roll in turn feed and consolidate the mat against a nose bar. The feed mat coming from the nose bar is again opened up into individual fibers by the action of the high speed primary lickerin. These individual fibers are in turn doffed from the lickerin by a highly controlled and uniform doffing air stream, the accuracy of uniformity of this doffing air stream is of paramount importance. The individual fibers are again deposited onto a second moving condenser screen to form a final mat to process.

Another object of the invention is to provide a method of injecting a fiber resin or powder resin into the highly controlled doffing air stream using a specially designed Venturi system. This unique system develops a vacuum in the resin feed chamber thus forcing the powder or fiber resin into the doffing air stream. The resin thus injected becomes very intimately blended with the doffing air and thus the fibers the doffing air is doffing from the final high speed lickerin. The final mat is thus formed with the resin or resin fiber being intimately blended into the final mat structure.

Still another object of the invention is to provide a method to control with a great deal of accuracy the final cross machine density profile. We have designed a series of individually controlled motor operated fingers in the doffing air stream, that in turn vary and control the velocity of the doffing air that is doffing the lickerin. We have also designed a system of individual louvers located on the final condenser screen that in conjunction with the fingers in the doffing air stream we can control the cross machine density profile with an extreme degree of accuracy.

Still another object of the invention is to provide a process wherein the width of the mat is controlled by varying the height of the second vertically disposed curtain.

An objective of the invention is to process a range of very short fibers such as wood pulp and long fibers such as textile, spun and bushing glass, and natural fibers such as Kenaf with fiber lengths in the 3 to 4 inch range by an air lay method.

Still another object of the invention is to provide a process wherein the width of the mat is controlled by varying the height of the second vertically disposed curtain.

A further feature of the present invention is to provide air lay apparatus for forming a product mat having an isotropic web structure wherein the apparatus includes an accumulator or doffing roll bin means which receives all the fibers to be processed and which includes means to form a first vertically disposed curtain of uniformly mixed fibers.

A further feature is to provide the air lay apparatus of the preceding paragraph wherein a backwardly inclined condenser has an inlet arranged to intercept the first vertically disposed curtain of uniformly mixed fibers to form all of the mixed fibers into a uniform feed mat with the mixed fibers uniformly distributed through the mat height and width.

A still further feature of the present invention is to provide distribution means for separating the constituent fibers of the feed mat and blending them with resin and catalyst material within a doffing air flow stream which is arranged to direct the blended material onto a final product condenser.

Yet another feature of the present invention is to provide such apparatus including accumulator or doffing roll bin fiber supply means producing a source of individual open fibers for supply to a first feeder condenser for controlling the density of a feed mat which is subsequently directed with respect to a lickerin cylinder for forming a source of uniform density fibers to be mixed with a resin and catalyst supply and subsequently to be air laid on a continuous belt condenser without traditional shingling; the accumulator or doffing roll bin fiber supply forming a vertical curtain of mixed fibers which have a low susceptibility to gravity separation; the first feeder condenser being rearwardly inclined for forming a uniform feed mat from the vertical curtain of mixed fibers; and the apparatus further including distribution means for blending individual fibers from said feed mat with resin and catalyst material and for directing the blended fibers, resin and catalyst as a second vertically disposed curtain to prevent air separation of the fibers in the blend.

A further feature of the apparatus of the present invention is t provide second condenser means located vertically below the distribution means to intercept the second vertically disposed curtain to produce a uniform lay-up of the blended material.

A still further feature of the apparatus of the present invention is that it includes means for adjusting the height of the second vertically disposed curtain to control the width of the final product web.

A particular feature is to provide such adjustment by an adjustable elevator platform for changing the vertical height difference between the product condenser means and the distribution means for varying the width of the web lay-up on the second condenser means.

Yet another feature of the present invention is to form the apparatus to have a final product condenser means in the form of a horizontal conveyor with a vacuum box and adjustment means being an elevator platform supported on adjustable jack means.

Yet another feature is to provide distribution means for blending fibers, resins and catalyst in which a source of doffing air flow directs a fiber pick-up stream in a vertical direction and wherein means are provided for varying the velocity of the doffing air flow.

A still further feature of the present invention is to provide the doffing air in a conduit arranged to have its flow path extending along a vertical axis, and means for varying the velocity of the primary air flow including a movable finger forming one surface of the conduit, and means for adjustably inclining the movable finger to reduce the cross-sectional flow area of the flow path so as to vary the velocity of the doffing air flow therethrough.

Another feature of the present invention is to provide such air lay apparatus in which the means for varying the velocity of the primary air flow includes a stepper motor having an output shaft connected to a movable finger selectively positioned in accordance with control signals directed to the stepper motor.

Another object is to improve such apparatus by initial fiber input through a vertical curtain of mixed fibers formed by an accumulator or doffing roll bin means having a horizontal conveyor for feeding and mixing fibers of different types to produce the vertical curtain at a vertical flow outlet located vertically below the horizontal conveyor for reducing gravitational separation between fibers of different type.

Another object is to improve apparatus features of the invention described above by providing feed mat condenser means including a feed plate inclined backwardly of the vertical axis through the vertical flow outlet to intercept the vertical curtain of fiber material and including means to vacuum draw fibers from the accumulator or doffing roll bin means to form a uniform density feed mat.

DETAILED DESCRIPTION OF A PREFERRED EMBODIMENT

Figure 1:
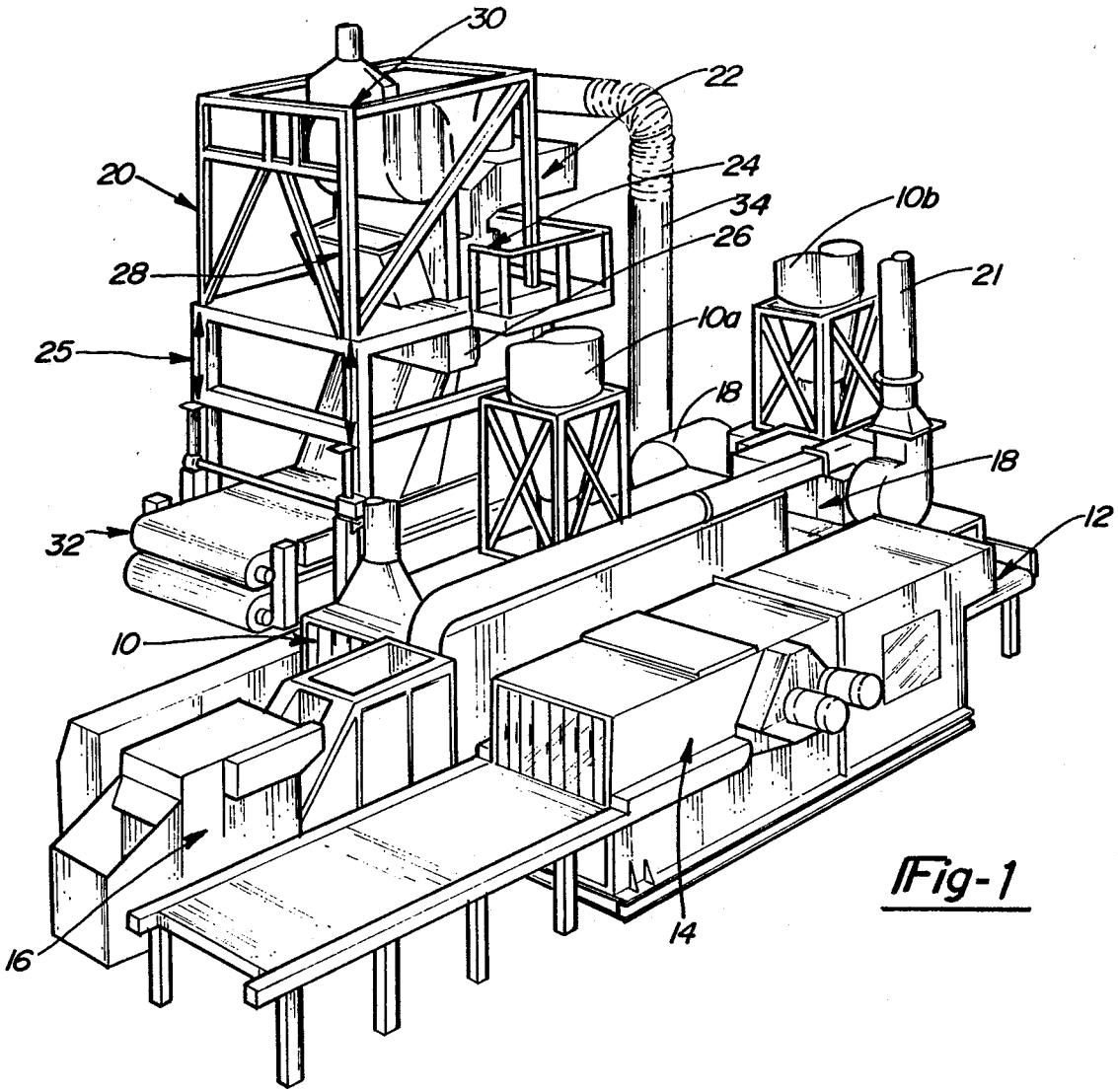
FIG. 1 is a perspective view of apparatus including the present invention.

Referring now to FIG. 1 of the drawings, the apparatus of the present invention includes a bail opener 10 for feeding a first source of fiber stock such as short wood pulp fibers or pressurized refined wood fibers to a blending conveyor 12. The bail opener 10 is associated with blending heads 10*a*, 10*b* for directing additives into the fiber stream of opener 10. Also provided is a bail opener 14 for feeding very long spun glass wool or bushing fibers to the blending conveyor 12. The spun glass fibers are almost infinitely long and can be either straight or non-straight.

Additionally, an opener blender 16 sold by Rando Machine Company of Macedon, N.Y., is used to supply textile fiber to the common blending conveyor 12 depending upon the desired blend of material. The common blending conveyor 12 feeds a pin drum opener 18 for blending the supplied fibers together into a very homogeneous mixture of different fibers. The homogeneous mixture is then directed into air lay apparatus 2 constructed and operated in accordance with the present invention. A separator 21 is provided to remove dust particles from the stream at blending conveyor 12.

In accordance with certain principles of the present invention, the air lay apparatus 20 includes accumulator or doffing roll bin 22 is provided to receive the homogeneous blend of fibers and to present a uniform vertical curtain of well opened fiber to a backward inclined feeder condenser 24. Both the accumulator or doffing roll bin and backwardly inclined feeder condenser 24 are supported by an elevator platform 25. The feeder condenser is arranged to serve as both a perforated surface for deposit and build up of a feed mat used in a blending operation at a distributor 26. The distributor 26 is associated with resin and catalyst supply conduits 28 and a doffing air conduit 30 to direct a second vertical curtain of blended, well opened, and uniformly dispersed fibers onto a final product forming condenser 32.

More, particularly the fibers from the pin drum opener 18 are directed through a supply conduit 34 to the interior 36 of the doffing roll bin 22. An expandable bellows section 35 in conduit 34 accommodates different positions of the bin 22, depending upon the position of elevator platform 25.

The interior 36 of bin 22 is in communication with a mechanical separator (not shown) in which the supply air is separated from any fibers which are not dropped into the interior 36. The accumulator or doffing roll bin 22 has an upper rack back chain system 28 to return excess fibers to a bottom apron conveyor 40 on which the supply of homogenous fibers collect.

The conveyor 40 includes a drive roller 42 and a return roller 44 over which a belt 46 is driven to move the collected fibers 48 into a set of picker rolls 50. An alternative technique would utilize a elevating apron and stripper roll or belt. The picker rolls 50 each have a roller 52 connected to a suitable drive (not shown). The rollers 52 each carry a plurality of pins 54 which further blend the homogeneous fibers on the belt 46 and cast them into an outlet chamber 58 located above and at the outlet end of the bin 22. The chamber 58 communicates with an outlet opening 60 located to receive doffed fibers which flow in a downwardly vertical direction through the outlet 60 in the bottom of the bin 22 at a point vertically above the entrance to the backward inclined feed condenser 32.

Figure 2:
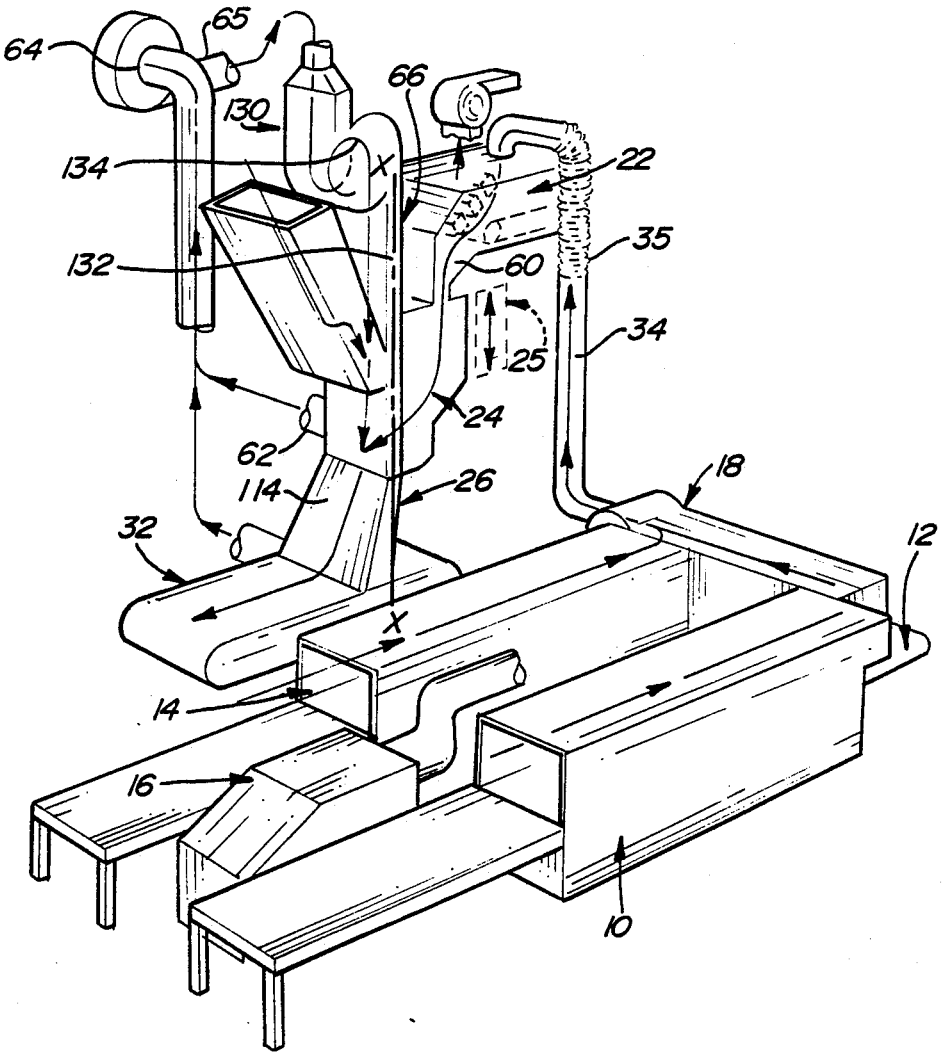
FIG. 2 is a diagrammatic representation of the primary flow paths for fibers processed by the apparatus of the present invention.

As shown in FIG. 2, the air flow for movement of the doffed fibers through the outlet 60 is produced by a suction system 62 that is connected to the inlet of a doffing air fan 64 by an expandable bellows section 65. Fan 64 has its discharge connected to a primary air supply system 66.

Figure 6:
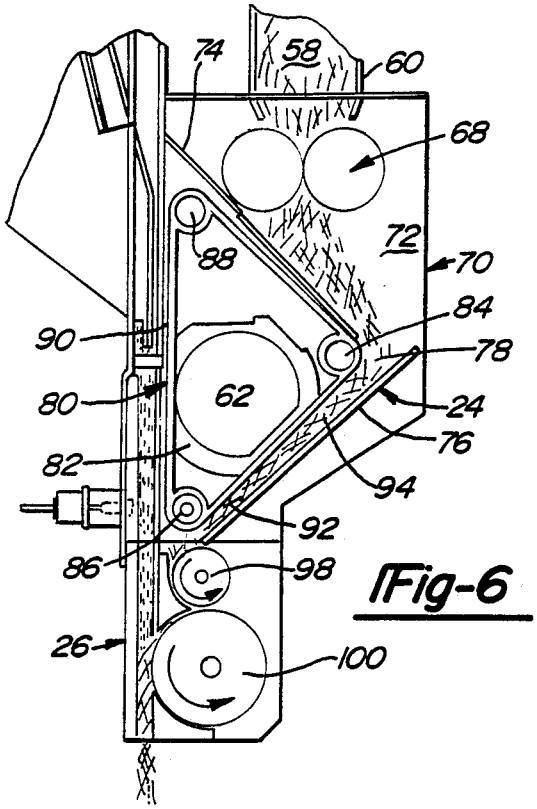
FIG. 6 is a diagrammatic view of a backward inclined feed mat condenser for directing a feed mat formed thereon into the fiber blending system of FIG. 8.

As shown in FIG. 6, the suction system 62 draws fibers from the outlet chamber 58 into the inlet to a pair of lickerin cylinders 68 located immediately below the outlet 60 in a sealed housing 70 that encloses the backward inclined feeder condenser 24. The lickerin cylinders 68 have peripheral teeth which comb the fibers drawn by the vacuum system 62 into the interior 72 of the housing 70 The lickerin cylinders 68 rotate in opposite directions twoard each other and produce a centrifugal discharge of homogeneous fibers against a first inclined plate 74 which cooperates with a second rearwardly inclined plate 76 to define the inlet 78 to a feed mat conveyor 80 that covers a vacuum box 82 of the suction system 62.

In particular, the feed mat conveyor 80 includes a drive roller 84, an outlet return roller 86, and a tensioning roller 88. A perforated belt 90 is directed over the respective roller, 84, 86, 88 all of which cooperate to define a moveable platform carrying a perforated belt 90. A feed mat 92 is formed by vacuum deposition of the individual fibers which are discharged from lickerin cylinders 68 into the inlet 78 to the perforated belt 90 a it passes over the inlet 94 to the vacuum box 82.

The backward disposition of the belt 90 and the resultant feed path of fibers are such that the deposited mat is arranged in such a way as to enable the pressure drop to be controlled across the vacuum chamber 72 from right to left as viewed in FIG. 6 thereby to control the mat density of fibers deposited on the perforated belt 90.

In one working embodiment, the perforated belt 90 is in the form of a wire screen of a mesh which will retain the smallest ones of the mixed fiber supply while returning dust or the like into the suction system 62 for later separation. The backwardly inclined condenser 24 eliminates the need to depend on bin level control to produce resultant uniformity in a feed mat formed for later stripping and flow from a former head.

Figure 8:
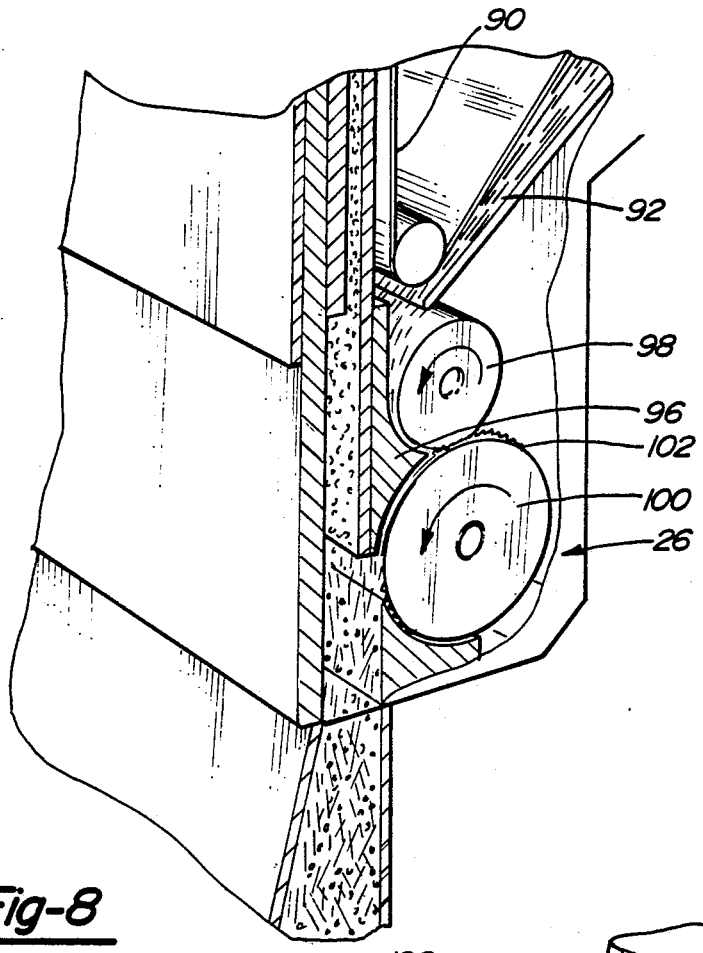
FIG. 8 is an enlarged perspective view of a distributor for directing feed mat fibers in the present invention.

In accordance with other features of the present invention, and as shown in FIG. 8, the feed mat 92 formed at the vacuum box 82 is moved in a downward direction by the perforated belt 90 to a nose bar 96 that reversely curves and refeeds the feed mat against a feed roll 98 that is rotated relative to a lickerin cylinder 100 with peripheral pins 102 thereon separate the uniform individual fibers from the feed mat 92 for centrifugal discharge into a doffing air stream generated by the doffing air supply 66.

An important feature of this invention is that the doffing roll bin 22, feeder condenser 24, feed roll 98, lickerin cylinder 100 and doffing air system 66 are all aligned along a vertical axis X—X. Such arrangement provides a final mat product with highly isotropic web structure from a wide range of fibrous materials such as glass, textile, wood and non wood fibers.

Further, the vertical disposition of the key components of the air lay apparatus 20 also enables the roll bin 22, feeder condenser 24, feed roll 98 and distributor 26 to be mounted on the elevator platform 25 for movement therewith. Such movement adjusts the distance between a former head and a continuously driven belt conveyor of the final product condenser 32 for reasons to be discussed.

Figure 9:
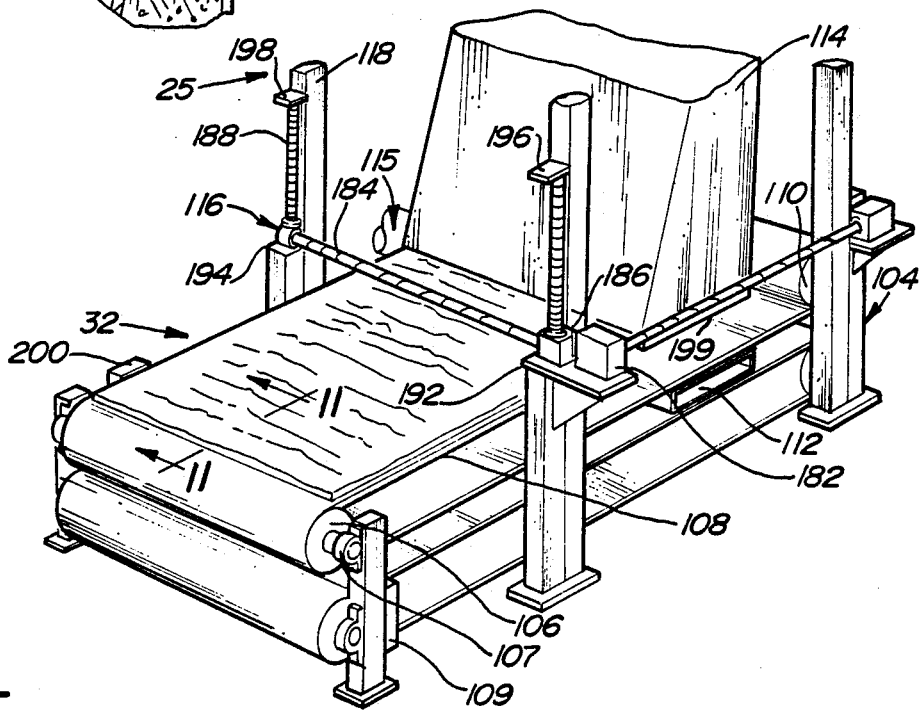
FIG. 9 is an enlarged perspective view of the final product condenser of the apparatus of the present invention in association with an elevator platform for adjusting the height of a former head.

In the FIG. 9 illustrated embodiment of the invention, the final product condenser 32 includes a conveyor platform 104 having rollers 106 journaled in bearing blocks 107, two of which are shown in FIG. 9. The rollers 106 have a perforated belt 108 directed thereover which is driven by a drive roller 110 with respect vacuum box 112 located below the former head 114 of the apparatus 20. The vacuum box 112 in turn is connected by a return conduit 115 to a suitable source of vacuum such as the inlet side of the doffing air fan 64.

In order to adjust the height of the form ®r head 114 it is connected to the elevator platform 25. Motor driven screw jacks 116 are located at each corner post 118 of elevator platform 25 for all of the vertically arranged components. When the jacks 116 are extended, the platform 25 will move up or down and will concurrently move the accumulator or doffing roll bin 22, feeder condenser 24, feed roll 98, lickerin cylinder 100 and doffing air supply 66 at the same time in the same vertical direction. The result is to produce a spread of the width of a vertical curtain of highly homogeneous fibers downwardly onto the perforated belt 108. The only further adjustment to change the width of the product mat is to provide replaceable apron extensions 120, 122 (shown in FIG. 12) which will extend between the discharge end 124 of the former head 120 to form a passage 126 to the surface 128 of the conveyor at the vacuum box 112 in order to maintain a vacuum on the conveyor at the vacuum box 112.

Figure 12:
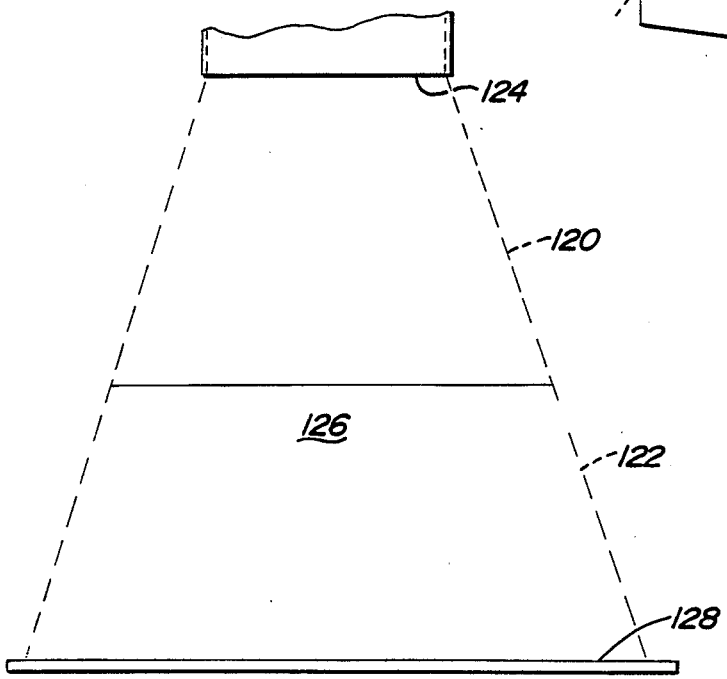
FIG. 12 is a diagrammatic view of the air flow pattern from the former head of FIG. 9 at different adjustments.

The possible width variations produced by different vertical adjustments of the elevator platform 118 with the flow components carried thereon is shown in FIG. 12 at three different raised positions from a reference retracted position of elevator platform 25 that produces a 40 inch mat; a first raised elevation of fifty one inches which produces a 65 inch mat and a second raised elevation of the elevator platform at 99 inches high which produces a width of mat on the conveyor of 88.5 inches.

Figure 3:
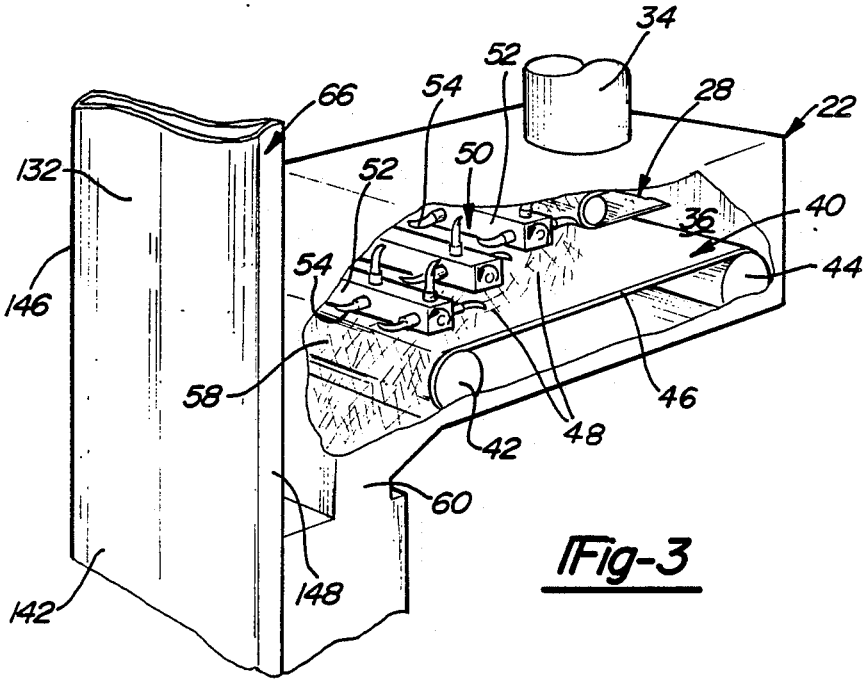
FIG. 3 is a fragmentary enlarged perspective view, partially broken away, of an accumulator or doffing roll bin means of the present invention.

Another feature of the present invention is an air flow control system 130 that also moves with the vertically adjustable elevator platform 25. The air flow system 130 includes an inlet duct 132 which connects to the outlet of the doffing air pump surge tank 134. The tank 134 is provided to damp pulsations from the doffing air fan 64 to improve the lateral velocity profile across the width on the inlet duct 132 which is representatively shown as having a thin rectangular shape as is best shown in FIG. 3.

The thin, rectangularly shaped duct 132 is arranged on the vertical axis X—X so that the doffing air stream will direct individual fibers separated from the feed roll 98 by the lickerin cylinder 100 will be directed straight down onto the horizontal belt 108 of the final product condenser 32. The straight down flow pattern produces a second vertical curtain for distributing the mixed fibers and eliminates any chance for air flow separation of the individual fibers as is the case in conventional air lay equipment. Consequently, the build up of the web mat in the final product is very uniform with the formation of a highly isotropic web structure suitable for formation into pressure and heat molded products of mechanical strength characteristics which approach the isotropy of steel.

Figure 4:
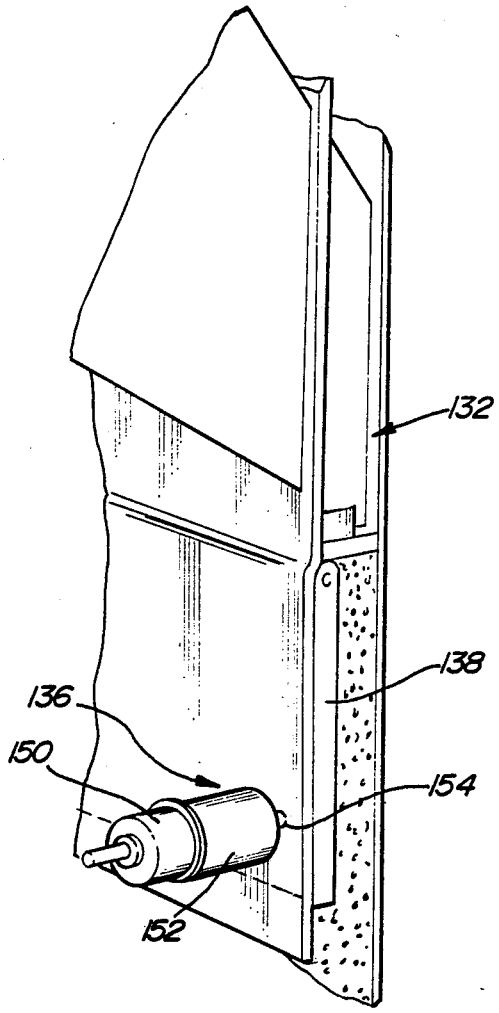
FIG. 4 is a fragmentary enlarged perspective view of a doffing air controller of the present invention in a maximum air velocity position.
Figure 5:
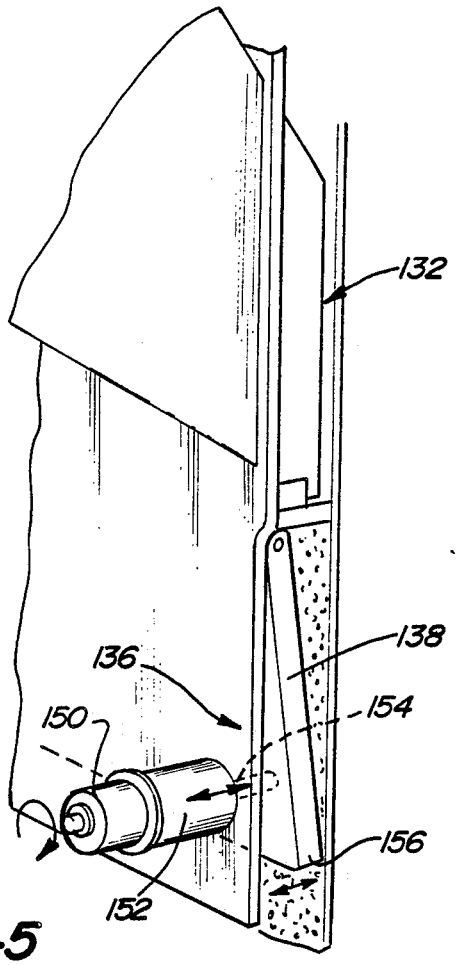
FIG. 5 is a view like FIG. 4 showing the doffing air controller in its minimum air velocity position.
Figure 7:
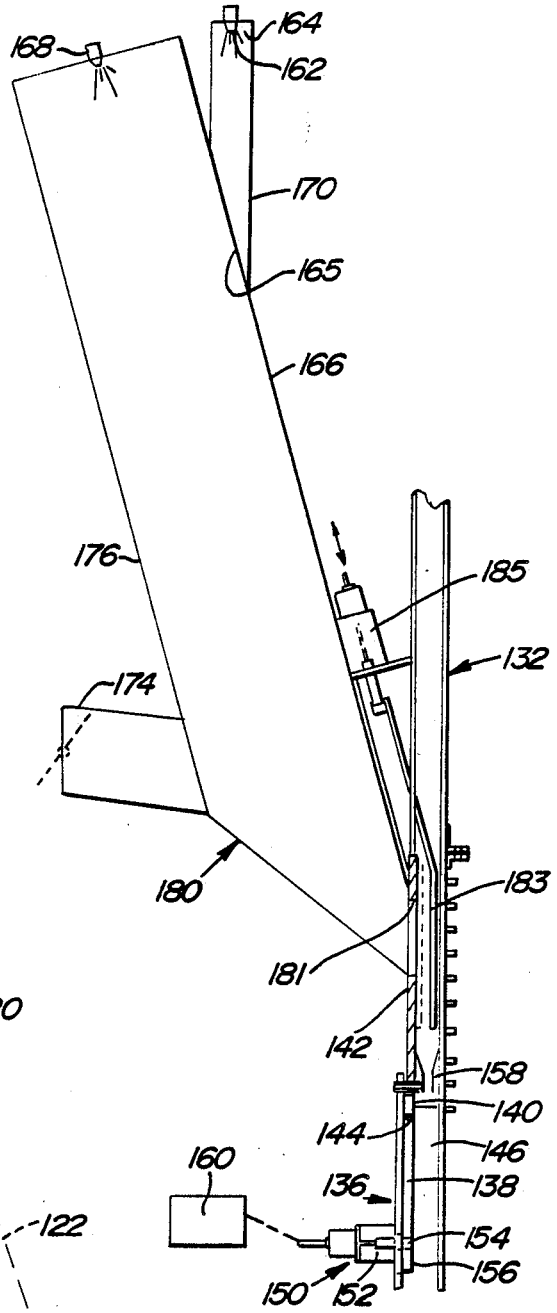
FIG. 7 is an enlarged sectional view of duct work for supplying resin, catalyst and bleed air into the blending system.

The vertical flow path defined by the inlet duct 132 includes an air velocity controller 136. As shown in FIG. 7, the air velocity controller 136 more particularly includes fingers or plates 138 each having an inlet end 140 located in vertical alignment with an outboard wall 142 of the inlet duct 132. The inlet end 140 is connected by a pivot pin 144 to side walls 146, 148 (FIG. 3) of the inlet duct 132. As a consequence, the fingers 138 can be pivoted between a fully open flow position as shown in FIG. 4 to a fully closed flow position as shown in FIG. 5 and can also be positioned at control points between the fully opened and closed positions.

The positioning of each of the fingers 138 is established by a stepper motor 150 which is under the control of the machine controller 160. Depending upon signals from controller 160, the stepper motor is incrementally driven to produce an incremental axial extension or retraction of a screw drive !52 having its output shaft 154 engageable with the controller fingers 138 adjacent a free outlet end 156 thereon to produce pivotal movement of the fingers 138 between the extreme control positions shown in FIGS. 4 and 5. The result is to be able to change the velocity of the doffing air flow as it meets and doffs the individual fibers from the lickerin cylinder 100. Such velocity control results in an ability to control the mat density profile on the perforated belt of the final product condenser 32.

A further advantage of the vertically arranged thin horizontal cross-sectioned inlet duct 132 is that it can be readily associated with the improved resin and catalyst injection system 28. The system 28 is provided to inject powder or fibrous forms of phenolic o other thermoset or thermoplastic resins directly into the doffing air stream where the resins are very intimately blended with the various types of mixed blended fibers, e.g., glass, textile and wood fibers as the are doffed from the lickerin cylinder 100. The system 28 includes a venturi 158 which is arranged below the outlets of a catalyst conduit 170 and a resin conduit 180.

In particular the catalyst conduit 170 has a catalyst injector 162 located in the inlet opening 164 thereof. The outlet end 165 of the catalyst conduit 170 is connected to the upper wall 166 of the resin conduit 180 as is best shown in FIG. 7. Consequently, the flow of catalyst is at an inclination of 15 degrees from the direction of resin flow through the interior of the resin conduit 180 to provide for thorough mixing of the resin and catalyst components. The resin conduit 180 has a resin injector 168 at its inlet end 172. A barometric damper 174 is provided at the lower end of the lower wall 176 of the resin conduit 180 to regulate bleed air flow into the doffing air system depending upon the velocity of the air flow across the venturi 158 as established by the position of the air velocity control finger 138. An inlet port 181 in duct 132 communicates conduit 180 with the upstream end of venturi 158. A valve 183 is selectively laterally positioned in duct 132 by a linear motor 185 to open and close inlet port 181. Accordingly, the resins and catalyst material will be directly impinged on the individual ones of the doffed fibers to produce a uniformly covered fiber array that will be uniformly deposited on the final condenser 32 as a mat impregnated with material which can be pressure and heat formed into high strength useful products such as door panel substrates, shelf panels, pallets and containers.

The production of either resin impregnated or plain mat material will produce a similar deposit on the perforated belt of the final condenser. In the working embodiment of the present invention the lickerin cylinder 100 has a fixed width of 40 inches and the ability to adjust the height of the former head 114 enables a single width lickerin cylinder to be used to produce a variety of mat widths as discussed above. The final mat width is only limited by the stroke of movement produced by the motor driven jack screws 116.

In the illustrated drive of FIG. 9, the platform 25 connects to jack screws 116 shown as including a drive motor 182 connected by a cross thread 184 to jacks 186, 188 supported on side plates 192, 194 to lift against side plates 196, 198 on the elevator platform 25. The cross thread 184 and a front to aft screw 199 synchronizes the amount of lift at each corner such that the discharge end 124 of former head 114 will be maintained in close parallelism to the deposit surface for the fibers.

Figure 10:
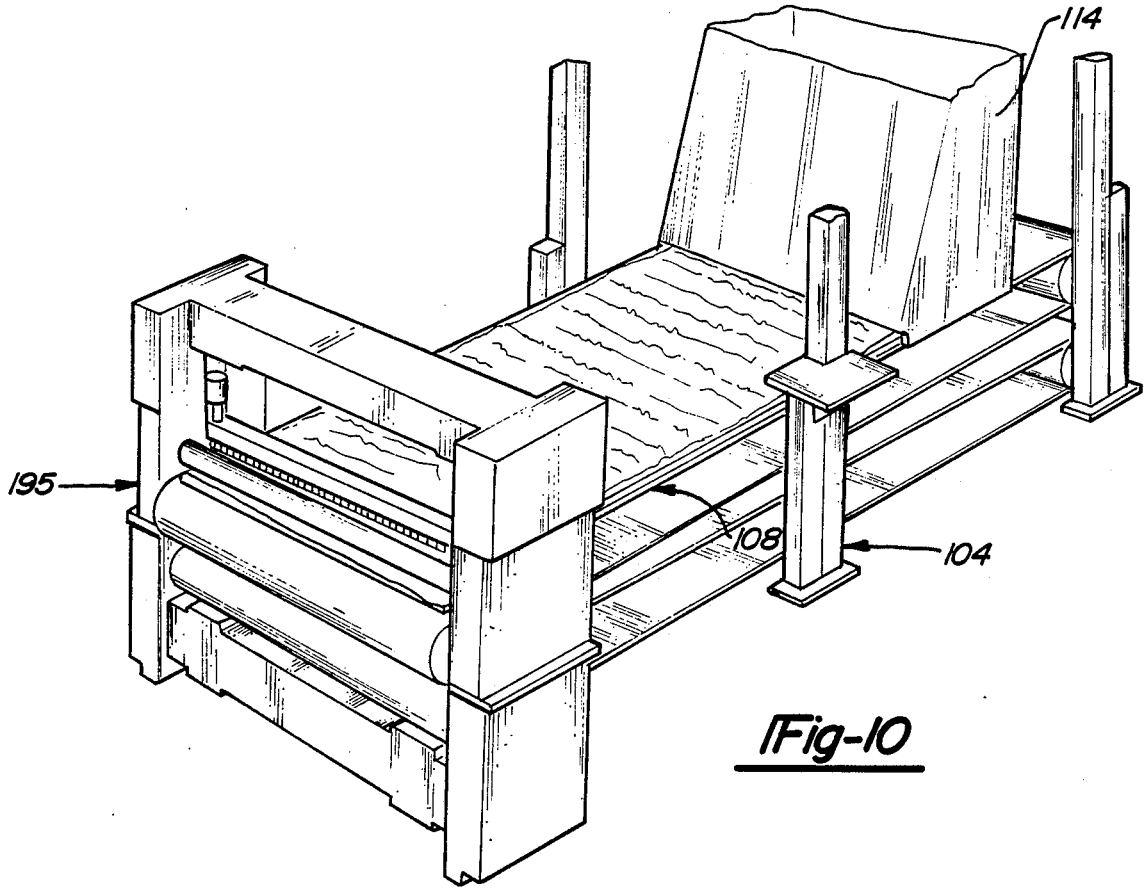
FIG. 10 is an enlarged perspective view like FIG. 9 showing the addition of a mat compressing roller means.
Figure 11:
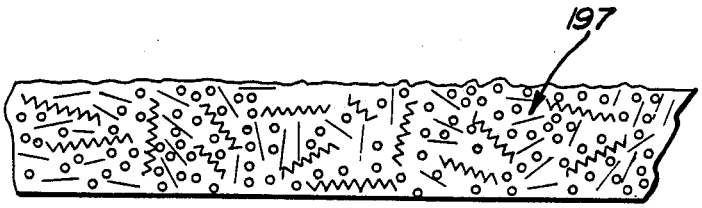
FIG. 11 is an enlarged fragmentary sectional of the product mat web of the present invention taken along the line 11—11 of FIG. 9 looking in the direction of the arrows.
Figure 13:
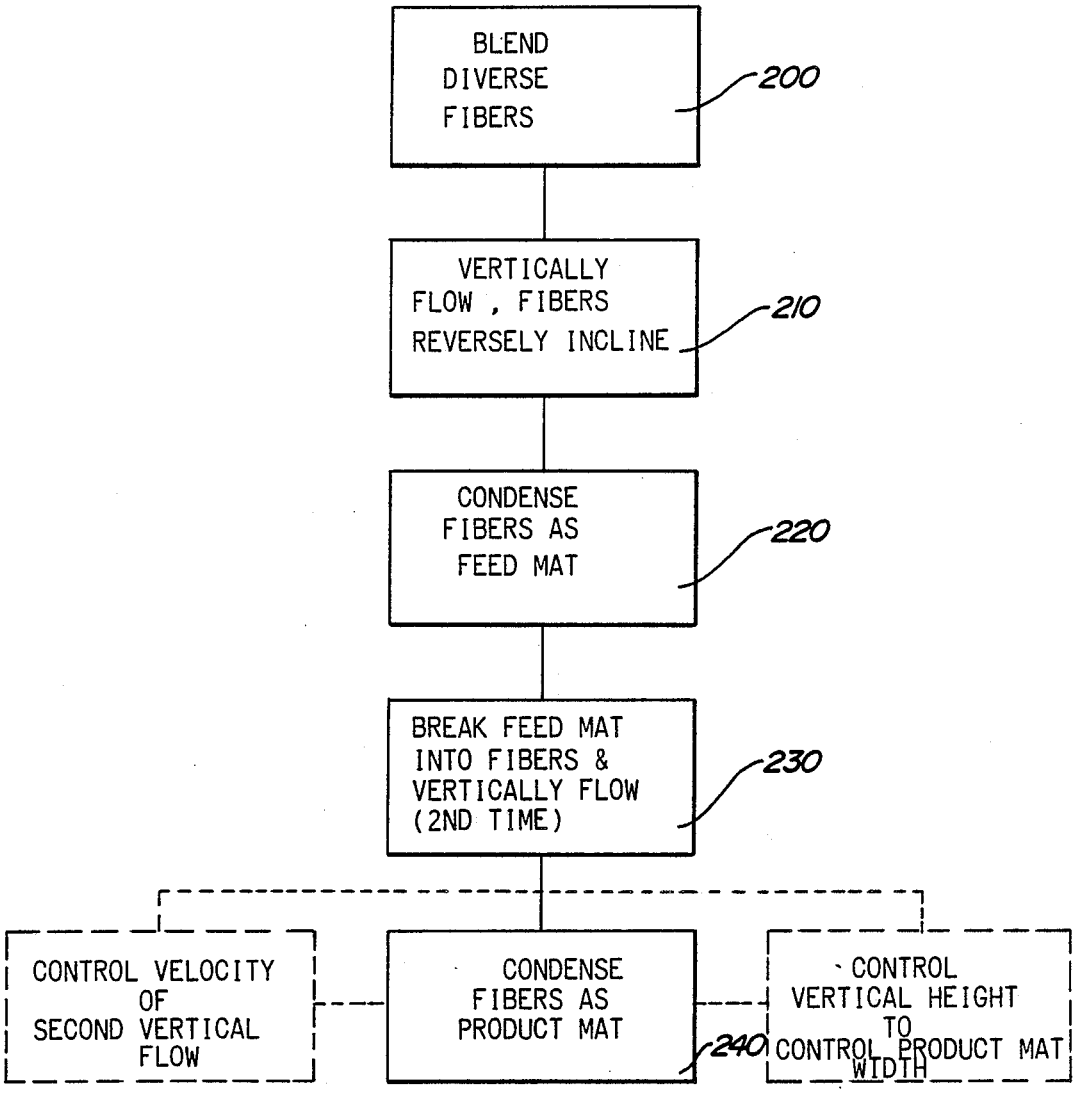
FIG. 13 is a flow chart of the method of the present invention.

In FIG. 10, a mat compression roller and needler 195 is shown to further process the highly isotropic mat product 197 shown in FIG. 11 a required.

The aforedescribed air lay apparatus 20 thus has machine controller regulation of the air velocity controller 136 and the height controller 115 arranged and operated to establish the final product's mat density. Such control can be automatically established by use of a nuclear basis weight gage 200 to measure the density of the final mat at the outlet of the final condenser 20 and to provide a feedback signal to the controller which can be compared to desired preprogrammed information within the addresses of known microprocessors to produce a continuous control signal to vary the air velocity controller 136 by adjustment of the stepper motor 150 to produce a velocity change that will keep the density within desired control limits.

The process of the present invention is suitable for use with a wide range of fiber types. The process is shown in block diagram form as including a process for laying a random mixture of fibers as a uniform density mat on a continuous basis characterized by the first step shown in block 200 as blending diverse fibers and distributing them in a first vertically disposed curtain.

The next step shown in block 210 includes directing the vertically flowing curtain in a first and second directions both inclined with respect to the vertically flowing curtain and oppositely inclined with respect to each other to form a supply of fibers.

The next step of the process of the present invention is to direct the supply of uniform fibers across a condenser to form them into a feed mat.

Then, as shown by block 230, the feed mat is broken into a second series of individual fibers and directed into a high velocity primary air pattern onto the individual fibers to form a second vertically disposed curtain.

Finally, as shown in block 240, the second vertically disposed curtain of individual fibers is directed against a condenser to form a product mat.

Alternatively, the process can include the step of controlling the velocity of the second vertically disposed curtain to control the thickness of the product mat.

As another alternative, the process can include controlling the vertical height between the vertically disposed curtain and the product condenser to control the width of the product mat.

In particular the last alternative can include the step of elevating the position of both the first and second vertical flow curtains to control the vertical height between the vertically disposed curtain and the product condenser to control the width of the product mat.

What is claimed is:

1. Apparatus including a fiber supply for producing a source of individual open fibers for supply to a first feeder condenser for controlling the density of a feed mat which is subsequently directed with respect to a lickerin cylinder for forming a source of uniform density fibers to be mixed with a resin and catalyst supply and subsequently air laid on a continuous belt condenser without traditional shingling comprising:

accumulator or doffing roll bin means including a horizontal conveyor for feeding and mixing fibers of different types to produce a vertical curtain supply of variable length fibers and including a vertical flow outlet located vertically below said horizontal conveyor for reducing velocity separation between fibers of different density;

feeder condenser means for picking up fiber from the said vertical flow outlet and for conveying said fibers in feed mat form;

said feeder condenser means including a feeder plate inclined backwardly of the vertical axis through said vertical flow outlet to intercept the uniform vertical curtain o fiber material and means to vacuum deposit fibers from said accumulator or doffing roll bin means to form a uniform density feed mat.

2. In the apparatus of claim 1, said feeder condenser means including a continuous conveyor belt with means for driving said conveyor belt in generally spaced parallelism with said backwardly inclined feeder plate and including a first conveyor roller at the inlet end of said feeder plate, a second return roller at the outlet end of said feeder plate and means for controlling the static pressure by controlling the vacuum across said conveyor belt between said first and second rollers so as to vary the density of material in said feed mat.

3. Apparatus including a fiber supply for producing a source of individual open fibers for supply to a first feeder condenser for controlling the density of a feed mat which is subsequently directed with respect to a lickerin cylinder for forming a source of uniform density fibers to be mixed with a resin and catalyst supply and subsequently air laid on a continuous belt condenser without traditional' shingling comprising:

means for forming a first vertical curtain of mixed fibers which have a low susceptibility to velocity separation;

first condenser means for forming a uniform feed mat from said vertical curtain of mixed fibers;

distribution means for blending individual fibers from said feed mat with resin and catalyst material and for directing the blended fibers, resin and catalyst in a second vertical curtain through a vertical discharge path to prevent air separation of the fibers in the blended fibers, resin and catalyst; and second condenser means located vertically below said distribution means to intercept said second vertical curtain to produce a uniform lay-up of the blended material; and means for adjusting the vertical height difference between said second condenser means and said distribution means for varying the width of the lay-up on said second condenser means.

4. In the apparatus of claim 3, said adjustment means including adjustable jack means for vertically positioning said distribution means with respect to said second condenser means for varying the width of the lay-up on said second condenser means.

5. In the apparatus of claim 3, said distribution means including a source of doffing air flow for directing a fiber pick-up stream in a vertical direction and means for varying the velocity of said doffing air flow before it intercepts fibers supplied thereto.

6. In the apparatus of claim 5, a conduit bounding said doffing air stream, said conduit being arranged to have its flow path extending along a vertical axis, said means for varying the velocity of said doffing air flow including a movable member, and means for adjustably inclining said movable member to reduce the cross-sectional flow area of said flow path so as to vary the velocity of said primary air flow therethrough.

7. In the apparatus of claim 5, said means for varying the velocity of said doffing air flow including a stepper motor having an output shaft and a flat plate connected to said stepper motor to be selectively positioned in accordance with signals directed to said stepper motor.

8. In the apparatus of claim 3, said means forming a first vertical curtain of mixed fibers including accumulator or doffing roll bin means having a horizontal conveyor for feeding fibers of different types to produce said first vertical curtain of variable length fibers and including a vertical flow outlet located vertically below said horizontal conveyor for reducing vertical separation between fibers of different type;

said first condenser means including a feed plate backwardly inclined from a vertical axis through said vertical flow outlet to intercept fibers and means to vacuum draw fibers from said accumulator or doffing roll bin means to form a uniform density feed mat.

9. In the apparatus of claim 5, said means for forming a vertical curtain of mixed fibers including accumulator or doffing roll bin means having a horizontal conveyor for feeding fibers of different types to produce said first vertical curtain of variable length fibers and including a vertical flow outlet located vertically below said horizontal conveyor for reducing vertical separation between fibers of different type;

said first condenser means including a feed plate backwardly inclined from a vertical axis through said vertical flow outlet to intercept fibers and means to vacuum draw fibers from said accumulator or doffing roll bin means to form a uniform density feed mat.

10. A process for air laying a random mixture of fibers as a uniform density mat on a continuous basis comprising:

blending the fibers and distributing said fibers in a first vertically disposed curtain;

directing the vertically disposed curtain in first and second directions both inclined with respect to said vertically disposed curtain and oppositely inclined with respect to each other to form a supply of fibers;

directing the supply of uniform fibers across a condenser to form them into a feed mat;

breaking up the feed mat into a second series of individual fibers and directing a high velocity doffing air stream onto the individual fibers to form a second vertically disposed curtain; and directing the second vertically disposed curtain of individual fibers against a condenser to form a product mat.

11. In the process of claim 10, controlling the velocity of the second vertically disposed curtain to control the thickness of the product mat.

12. In the process of claim 10, controlling the vertical height between the vertically disposed curtain and the product condenser to control the width of the product mat.

13. In the process of claim 11, controlling the vertical height between the vertically disposed curtain and the product condenser to control the width of the product mat.

* * * * *